US006561882B2

(12) United States Patent
Mizutani et al.

(10) Patent No.: US 6,561,882 B2
(45) Date of Patent: May 13, 2003

(54) GRINDING METHOD AND NUMERICALLY CONTROLLED GRINDING MACHINE

(75) Inventors: Yoshihiro Mizutani, Aichi-ken (JP); Masashi Yoritsune, Aichi-ken (JP); Ryohei Mukai, Aichi-ken (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/100,116

(22) Filed: Mar. 19, 2002

(65) Prior Publication Data

US 2003/0017790 A1 Jan. 23, 2003

(30) Foreign Application Priority Data

Mar. 26, 2001 (JP) ..... 2001-088681

(51) Int. Cl.[7] ..... B24B 1/00

(52) U.S. Cl. ..... 451/58; 451/5; 451/8; 451/9; 451/10; 451/11; 451/49; 451/177; 451/179; 451/364; 451/398

(58) Field of Search ..... 451/5, 8, 9, 10, 451/11, 49, 58, 177, 179, 364, 398

(56) References Cited

U.S. PATENT DOCUMENTS 4,528,781 A * 7/1985 Koide et al. ..... 451/62
4,747,236 A * 5/1988 Wedeniwski ..... 451/11
4,848,038 A 7/1989 Maruyama et al.

FOREIGN PATENT DOCUMENTS

JP 06-41095 6/1994

* cited by examiner

*Primary Examiner*—Joseph J. Hail, III
*Assistant Examiner*—Shantese McDonald
(74) *Attorney, Agent, or Firm*—Oblon, Spivak, McClelland, Maier & Neustadt, P.C.

(57) ABSTRACT

A circular or non-circular workpiece is ground in a plurality of grinding steps, including a final finish grinding step. A grinding wheel is caused to effect profile generation movement in synchronism with rotation of the workpiece and in accordance with profile data derived from the target shape of the workpiece. In each grinding step, the grinding wheel is advanced in such a manner that the grinding wheel causes cut-in movement within a predetermined cut-in angle defined on the workpiece. After completion of the final finish grinding step, the grinding wheel is retracted over a predetermined back-off angle defined on the workpiece. The retraction is effected in accordance with composite data obtained through combining the profile data and back-off data. The back-off angle is greater than the cut-in angle employed during the final finish grinding step.

10 Claims, 6 Drawing Sheets

Table

| Grinding step | Start dia. (mm) | Cut-in amount (ϕmm/rev) | Cut-in number | Total cut-in amount (ϕmm) | Cut-in angle (degrees) | | |
|---|---|---|---|---|---|---|---|
| | | | | | t1 | T2 | T3 |
| 1: First rough | 35.005 | 0.5 | 2 | 1.0 | 60 | 60 | 60 |
| 2: Second rough | 34.005 | 0.25 | 4 | 1.0 | 60 | 60 | 60 |
| 3: First fine | 33.005 | 0.2 | 5 | 1.0 | 60 | 60 | 60 |
| 4: Second fine | 32.005 | 0.125 | 10 | 1.25 | 40 | 40 | 60 |
| 5: First finish | 30.755 | 0.05 | 15 | 0.75 | 40 | 30 | 60 |
| 6: Second finish | 30.005 | 0.005 | 1 | 0.005 | 20 | 20 | 60 |
| | | | 37 | 5.005 | | | |

GRINDING METHOD AND NUMERICALLY CONTROLLED GRINDING MACHINE

BACKGROUND OF THE INVENTION

1. Field of the Invention

The present invention relates to a grinding method for grinding a workpiece having a non-circular portion, such as a cam, or a circular portion (hereinafter a workpiece having a non-circular portion or circular portion may be referred to as a "non-circular or circular workpiece") by means of profile generation movement of a grinding wheel, and to a numerically controlled grinding machine which carries out the grinding method.

2. Description of the Related Art

Conventionally, a numerically controlled grinding machine is used to grind a non-circular workpiece, such as a cam, or a circular workpiece having a circular cross section and being eccentric from the rotational axis. In such a numerically controlled grinding machine, by use of a numerical controller, feed of a grinding wheel perpendicular to the axis of a main spindle for supporting the workpiece is controlled in synchronism with rotation of the main spindle. In order to effect synchronized control of the feed of the grinding wheel, profile data must be supplied to the numerical controller. The profile data include an amount of movement of the grinding wheel per unit rotational angle of the spindle which defines a reciprocation movement; i.e., profile generation movement of the grinding wheel along the finished or target shape of the workpiece.

In addition to the profile data, machining cycle data are also required in order to grind the workpiece. The machining cycle data are used to control a machining cycle which includes feed, cut-in feed, and retraction of the grinding wheel. The workpiece is ground on the basis of the machining cycle data and the profile data. In such a grinding operation, the relation between a back-off movement of the grinding wheel and the profile generation movement of the grinding wheel after completion of grinding is very important for attaining high grinding accuracy and high grinding speed.

Due to limited functions of the conventional grinding machine, when the grinding wheel is to be retracted after completion of grinding, the grinding machine must be operated in the sequence of stopping rotation of the main spindle and then retracting the grinding wheel rapidly. However, if the rotation of the main spindle is stopped while the rotating grinding wheel remains in contact with the workpiece, the workpiece is pressed against the grinding wheel by means of a so-called spring-back effect of the mechanical system, with the result that a surface of the workpiece in contact with the grinding wheel is ground and a depression is formed on the contact surface.

In view of the foregoing, an improved numerically controlled grinding machine which can solve the above-described problem has been proposed (see Japanese Patent Publication (kokoku) No. 6-41095. In the improved numerically controlled grinding machine, back-off data for controlling back-off movement of the grinding wheel after completion of spark-out are combined with profile data within a predetermined angle range defined on the workpiece, in order to superpose the back-off movement on the profile generation movement, whereby the grinding wheel is caused to effect back-off movement without stoppage of the main spindle.

The principle of the grinding method will be described with reference to FIG. 1.

FIG. 1 shows a locus of movement of a grinding wheel relative to a non-circular workpiece when the workpiece is ground by use of a numerically controlled grinding machine. Reference letter O denotes the axis of a main spindle; W denotes the non-circular workpiece; and G denotes the grinding wheel. Since the grinding wheel G reciprocates along an X direction in synchronism with rotation of the workpiece W in a θ direction, when viewed in a coordinate system fixed to the workpiece W, the grinding wheel G revolves around the workpiece W in a direction of arrow A. During rough grinding, fine grinding, and finish grinding steps, cut-in advancement movements d1, d2, and d3 are carried out, respectively, in a section extending over a rotation angle θ2. In FIG. 1, broken lines indicate the outer diameters of the workpiece W before the cut-in advancement movements d1, d2, and d3; and chain lines indicate the positions of the grinding wheel G before the cut-in advancement movements d1, d2, and d3. Reference letter L denotes a locus of the center of the grinding wheel G when the grinding wheel G carries out the profile generation movement relative to the workpiece W (during spark-out).

The grinding method employed in the above-described grinding machine carries out, without stopping the main spindle, the profile generation movement and the back-off movement after completion of grinding in parallel. That is, during spark-out, the grinding wheel G moves along the locus L in order to generate a profile on the workpiece W, and the profile generation (spark-out) is ended at point P1. Subsequently, the grinding wheel G is fed along a curved line extending from point P1 to point P2, whereby the grinding wheel is retracted within the section of the rotational angle θ1. In this section, the profile generation movement and the back-off movement are performed concurrently. Subsequently, if necessary, the main spindle is stopped at point P2, and the grinding wheel G is retracted to point P3 at high speed.

Specifically, after completion of grinding, data for defining the back-off movement are supplied from data setting means and are combined with previously supplied profile data by data combining means. The data combining is performed in such a manner that the back-off movement is superposed on the profile generation movement; i.e., in such a manner that the grinding wheel G moves along the curved line extending from point P1 to point P2. The grinding wheel back-off means controls the position of the grinding wheel on the basis of the combined data and in accordance with the rotation angle of the main spindle.

Although the above-described grinding wheel back-off means solves the problem of a depression being formed on the workpiece upon completion of grinding, the conventional grinding method has a drawback of requiring a long machining time, because all of the conventionally employed grinding steps, including rough grinding, fine grinding, finish grinding, and spark-out grinding, must be performed without omission.

SUMMARY OF THE INVENTION

Accordingly, an object of the present invention is to provide an improved grinding method for grinding non-circular or circular workpieces which can avoid the problem of a depression being formed on a workpiece upon completion of grinding and which can shorten machining time.

Another object of the present invention is to provide an improved numerically controlled grinding method which carries out the grinding method.

In order to achieve the first object, the present invention provides a method for grinding a circular or non-circular workpiece in a plurality of grinding steps, the method comprising: causing a grinding wheel to effect profile generation movement in synchronism with rotation of the workpiece and in accordance with profile data derived from the target shape of the workpiece; advancing, in each grinding step, the grinding wheel in such a manner that the grinding wheel causes cut-in movement within a predetermined cut-in angle defined on the workpiece; and retracting, after completion of a final finish grinding step, the grinding wheel over a predetermined back-off angle defined on the workpiece, the retraction being effected in accordance with composite data obtained through combining the profile data and back-off data, the back-off angle being greater than the cut-in angle employed during the final finish grinding step.

Since the grinding method according to the present invention can eliminate spark-out grinding, which has conventionally been performed after final finish grinding, required machining time can be shortened.

Preferably, the cut-in angle employed during the final finish grinding is not greater than one-third the back-off angle. Preferably, the cut-in angle is decreased stepwise toward the final finish grinding step.

Although the above-described effect is attained insofar as the cut-in angle during the final finish grinding step is smaller than the back-off angle, the workpiece can be machined to high accuracy without fail when the cut-in angle during the final finish grinding is not greater than one-third the back-off angle and/or when the cut-in angle is decreased stepwise toward the final finish grinding step.

In order to achieve the second object, the present invention provides a numerically controlled grinding machine for grinding a circular or non-circular workpiece in a plurality of grinding steps, the grinding machine comprising: a movement mechanism for moving a grinding wheel relative to the workpiece; a storage unit for storing profile data derived from the target shape of the workpiece and defining profile generation movement of a grinding wheel to be performed in synchronism with rotation of the workpiece, machining cycle data defining at least a cut-in feed amount and a cut-in angle to be used in each grinding step, and back-off data defining at least a back-off angle to be used in a back-off step; and a control unit connected to the movement mechanism and the storage unit. The control unit causes the grinding wheel to effect profile generation movement in synchronism with rotation of the workpiece and in accordance with the profile data; advances, in each grinding step, the grinding wheel in such a manner that the grinding wheel undergoes cut-in movement within a corresponding cut-in angle; and retracts, after completion of a final finish grinding step, the grinding wheel over the back-off angle, the retraction being effected in accordance with composite data obtained through combining the profile data and back-off data, the back-off angle being greater than the cut-in angle employed during the final finish grinding step.

Since the grinding machine according to the present invention can eliminate spark-out grinding, which has conventionally performed after final finish grinding, required machining time can be shortened.

Preferably, the control unit decreases the cut-in angle stepwise toward the final finish grinding step. In this case, since the volume of an unground portion left after completion of the final finish grinding decreases, the required machining time can be shortened further, and more accurate grinding is enabled.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An embodiment of the present invention will be described with reference to FIGS. 2 to 6.

Figure 1:
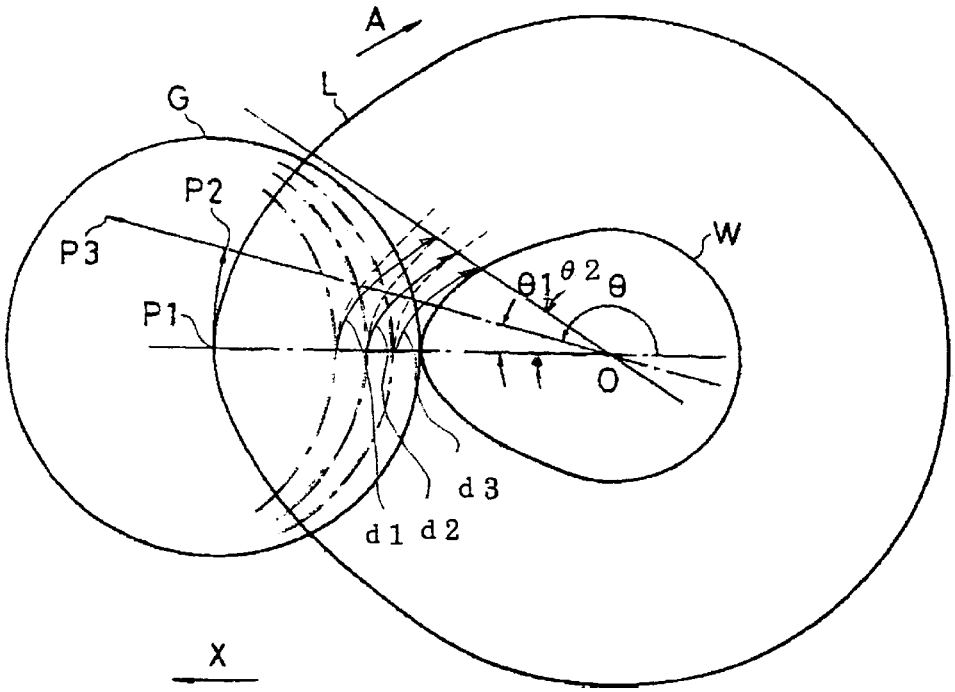
FIG. 1 is an explanatory diagram showing back-off movement of a grinding wheel according to the present invention.
Figure 2:
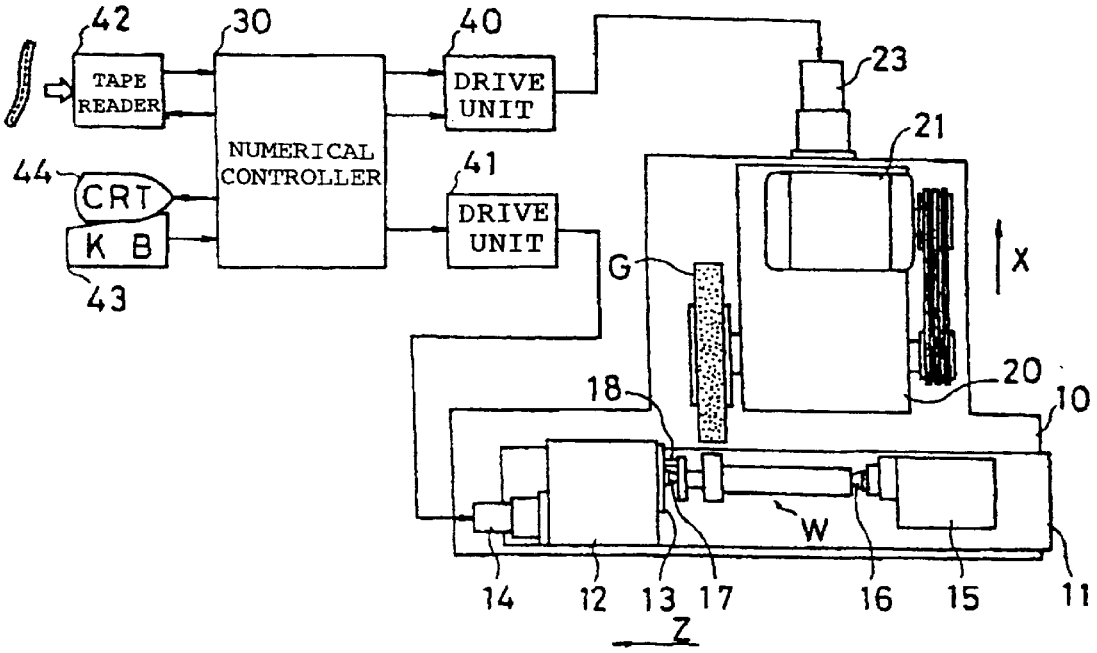
FIG. 2 is a schematic view of a numerically controlled grinding machine according to an embodiment of the present invention.

FIG. 2 schematically shows a numerically controlled grinding machine according to the embodiment of the present invention. Reference numeral 10 denotes a bed, on which a table 11 is slidably disposed. A workhead 12 is mounted on the left-hand end of the table 11. The workhead 12 rotatably supports a main spindle 13, which is connected to a servomotor 14 so as to be rotated thereby. A tail stock 15 is mounted on the right-hand end of the table 11. A workpiece W (a cam shaft in the present embodiment) is held between a center 17 attached to the main spindle 13 and a center 16 attached to the tail stock 15. The left-hand end of the workpiece W as viewed in FIG. 2 is engaged with a positioning pin 18, which projects from the main spindle 13, so as to synchronize the rotational phase of the workpiece W with the rotational phase of the main spindle 13. A wheel head 20 is slidably guided on a rear portion of the bed 11 for movement toward and away from the workpiece W. A grinding wheel G, which is rotated by a motor 21, is supported on the wheel head 20. The wheel head 20 is connected to a servomotor 23 through a feed screw (not shown), so that the wheel head 20 is advanced and retracted by the servomotor 23.

Drive units 40 and 41 are interposed between the numerical controller 30 and the servomotors 23 and 14, respectively. Upon receipt of command pulses from the numerical controller 30, the drive units 40 and 41 drive the servomotors 23 and 14, respectively. The numerical controller 30 mainly controls the servomotor 23 and 14 in a synchronized manner so as to grind the workpiece W. A tape reader 42, a keyboard 43, and a CRT display 44 are connected to the numerical controller 30. The tape reader 42 is used to input profile data, machining cycle data, etc. The keyboard 43 is used to input control data, etc. The CRT display device 44 is used to display various types of information.

Figure 3:
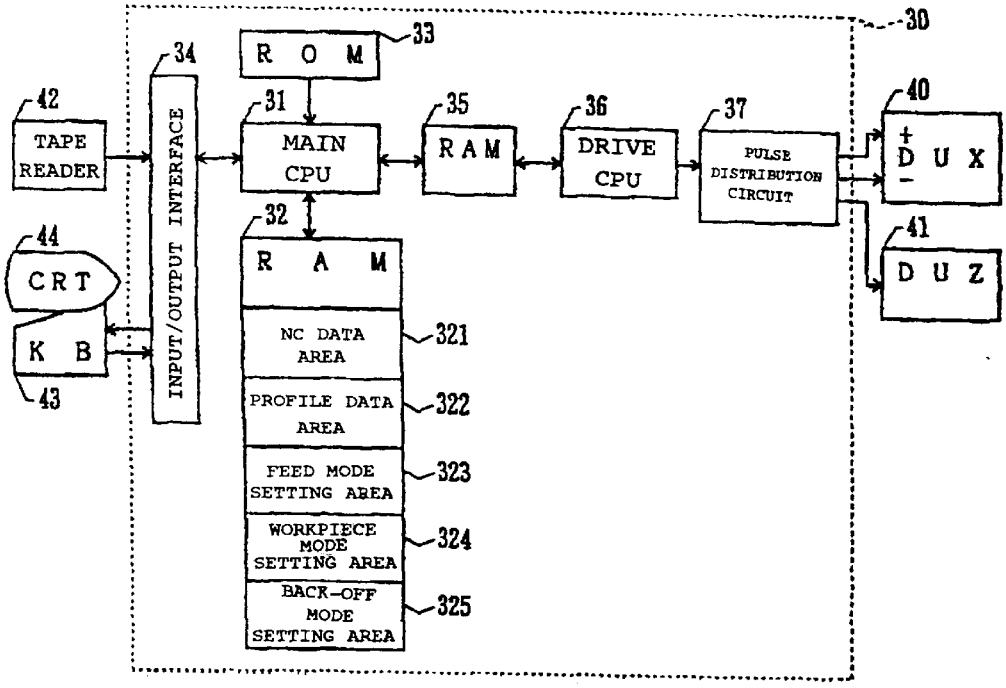
FIG. 3 is a block diagram showing the structure of the numerical controller shown in FIG. 2.

As shown in FIG. 3, the numerical controller 30 comprises a main central processing unit (hereafter referred to as a "main CPU") 31, a read only memory (ROM) unit 33 which stores a control program, a random access memory (RAM) unit 32 which stores input data, etc., and an interface 34. The RAM 32 includes an NC data area 321 for storing numerical control programs, and a profile data area 322 for storing profile data. The RAM 32 also includes a feed mode setting area 323, a workpiece mode setting area 324, and a back-off mode setting area 325, which are used for mode setting. The numerical controller 30 further comprises a drive CPU 36, RAM 35, and a pulse distribution circuit 37 for distributing command pulses to the drive units 40 and 41. The RAM 35 stores positioning data sent from main CPU 31. The drive CPU 36 executes calculations for slow up, slow down, and interpolation on the basis of the positioning data sent from the main CPU 31 via the RAM 35, and outputs movement amount data and velocity data at predetermined intervals. The pulse distribution circuit 37 distributes feed command pulses to the drive units 40 and 41 in accordance with the movement amount data and velocity data.

NC data including machining cycle data are stored in the RAM 32. The CPU 31 reads and decodes the NC data in accordance with a programmed procedure in order to perform the respective steps of a machining cycle.

Figure 4:
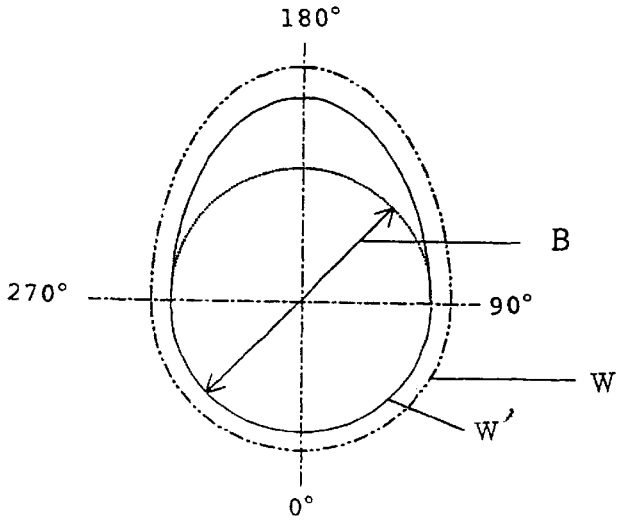
FIG. 4 is an explanatory diagram showing profiles of a non-circular workpiece before and after a grinding operation.

Here, there will be described the case in which a non-circular cam (workpiece W) having a base circle (B) of 30 mmϕ shown in FIG. 4 is subjected to profile generation grinding. Notably, the present invention can be applied effectively to the case in which a workpiece, such as a crank pin, which-has a circular cross section and is eccentric with respect to the rotational axis.

The cam shown in FIG. 4 has a profile indicated by a two-dot chain line (shown as a cam W having a base circle diameter of 35.005 mm) before grinding, and has a profile indicated by a solid line (shown as a cam W' having a base circle diameter of 30.000 mm) after completion of grinding.

When such a workpiece is to be subjected to profile generation grinding, a cut-in feed start position is typically selected to be located on the base circle portion (e.g., at an angle of 0 degree). As shown in Table provided below, a machining cycle includes six steps in total; i.e., first rough grinding, second rough grinding, first fine grinding, second fine grinding, first finish grinding, and second finish grinding.

TABLE

| Grinding step | Start dia. (mm) | Cut-in amount (ømm/ rev) | Cut-in number | Total cut-in amount (ømm) | Cut-in angle (degrees) t1 | T2 | T3 |
|---|---|---|---|---|---|---|---|
| 1: First rough | 35.005 | 0.5 | 2 | 1.0 | 60 | 60 | 60 |
| 2: Second rough | 34.005 | 0.25 | 4 | 1.0 | 60 | 60 | 60 |
| 3: First fine | 33.005 | 0.2 | 5 | 1.0 | 60 | 60 | 60 |
| 4: Second fine | 32.005 | 0.125 | 10 | 1.25 | 40 | 40 | 60 |
| 5: First finish | 30.755 | 0.05 | 15 | 0.75 | 40 | 30 | 60 |
| 6: Second finish | 30.005 | 0.005 | 1 | 0.005 | 20 | 20 | 60 |
| | | | 37 | 5.005 | | | |

In the example shown in the Table, in the first step, first rough grinding is started at a position of 35.005 mmϕ in such a manner that cut-in feed is effected two times (0.5 mmϕ in each revolution) in order to attain a total cut-in amount of 1.0 mmϕ (i.e., the total number of revolutions of the workpiece is 2). A cut-in angle within which the cut-in feed of 0.5 mmϕ is completed is set to 60 degrees, as indicated in column t1. That is, the grinding wheel G is continuously fed in the X direction in an amount of 0.5 mmϕ in synchronism with 60-degree rotation of the workpiece.

In the second step, second rough grinding is performed. Since the workpiece has a diameter of 34.005 mm after completion of the first rough grinding, this position (diameter) serves as a second rough grinding start position (diameter). From this position, second rough grinding is performed in such a manner that cut-in feed is effected four times (0.25 mmϕ in each revolution) in order to attain a total cut-in amount of 1.0 mmϕ (i.e., the total number of revolutions of the workpiece is 4). The cut-in angle t1 during the second rough grinding is also 60°.

In the third step, first fine grinding is performed. Since the workpiece has a diameter of 33.005 mm after completion of the second rough grinding, this position (diameter) serves as a first fine grinding start position (diameter). From this position, first fine grinding is performed in such a manner that cut-in feed is effected four times (0.2 mmϕ in each revolution) in order to attain a total cut-in amount of 1.0 mmϕ (i.e., the total number of revolutions of the workpiece is 5). The cut-in angle t1 during the second rough grinding is also 60°.

In the fourth to sixth steps, second fine grinding, first finish grinding, and second finish grinding are performed in the similar manner as in the above-described steps. In these steps, the cut-in amount/per revolution and the cut-in angle (t1) are reduced with progress toward the second finish grinding.

For the sixth step for second finish grinding (final finish grinding), the cut-in amount is set to a small value (0.005 mmϕ), and the cut-in angle (t1) is set to a small value (20°). Therefore, the volume of a residual portion which is left after completion of the finish grinding can be reduced.

In the machining example shown in Table, the cut-in feed is effected in a total amount of 5.005 mmϕ during a period in which the workpiece rotates 37 turns in total, whereby a cam W' (workpiece) having a desired base-circle diameter of 30 mm is obtained.

Notably, instead of the cut-in angles in column t1, cut-in angles in column t2 may be employed in the respective grinding steps. Even for the cut-in angles in column t2, the cut-in angle is decreased stepwise to 20°, which is the cut-in angle for the final finish grinding. Column t3 shows conventionally employed fixed cut-in angles (i.e., 60° for all steps).

The grinding steps shown in the Table will be described with reference to FIG. 5.

From the grinding start position (point q1) of the first step, profile generation grinding and cut-in feed in an amount of 0.5 mmϕ are performed simultaneously over an angular range of 0 to $\pi/3$ (60°) with respect to rotation of the workpiece, and the cut-in feed is then stopped (point q2). Within a section between point q2 and point q3, profile generation grinding is performed until the workpiece rotates one turn ($2\pi$). Similarly, within a section between point q3 and point q4, profile generation grinding and cut-in feed in an amount of 0.5 mmϕ are performed simultaneously over an angular range of $2\pi$ to $7\pi/3$ (60°); and within a section between point q4 and point q5, the profile generation grinding is performed. As a result, the first step is completed, and the workpiece has a diameter (base-circle diameter) of 34.005 mm (point q5). Subsequently, the remaining steps are performed sequentially through performance of profile generation grinding and cut-in feed. In the final step 6, which is started when the diameter (base-circle diameter) of the workpiece has reached 30.005 mm, within a section between point q10 and point q11, profile generation grinding and cut-in feed in an amount of 0.005 mmϕ are performed simultaneously over a cut-in angle (ti) of 20°; and within a section between point q11 and-point qe, profile generation grinding is performed. Subsequently, the second finish grinding is ended (point qe). In the present invention, conventionally-performed spark-out grinding is not required.

After completion of grinding, the grinding wheel G is caused to effect back-off movement, along with profile generation movement, over an angle of 90° (i.e., within a section between qe and qg). When rapid retraction is instructed, the main spindle is stopped, and the grinding wheel G is retracted at a rapid rate within a section between point qg to point qh. During the back-off movement, a back-off amount per unit angle is subtracted from profile data which are read out successively in order to compose movement amount data (i.e., back-off movement is superposed on profile generation movement by means of data combining means); and on the basis of the composite data, the grinding wheel G is retracted in synchronism with rotation of the main spindle.

The reason whey the present invention can eliminate spark-out grinding, which would otherwise be performed after completion of final finish grinding, will be described with reference to FIG. 6.

Figure 5:
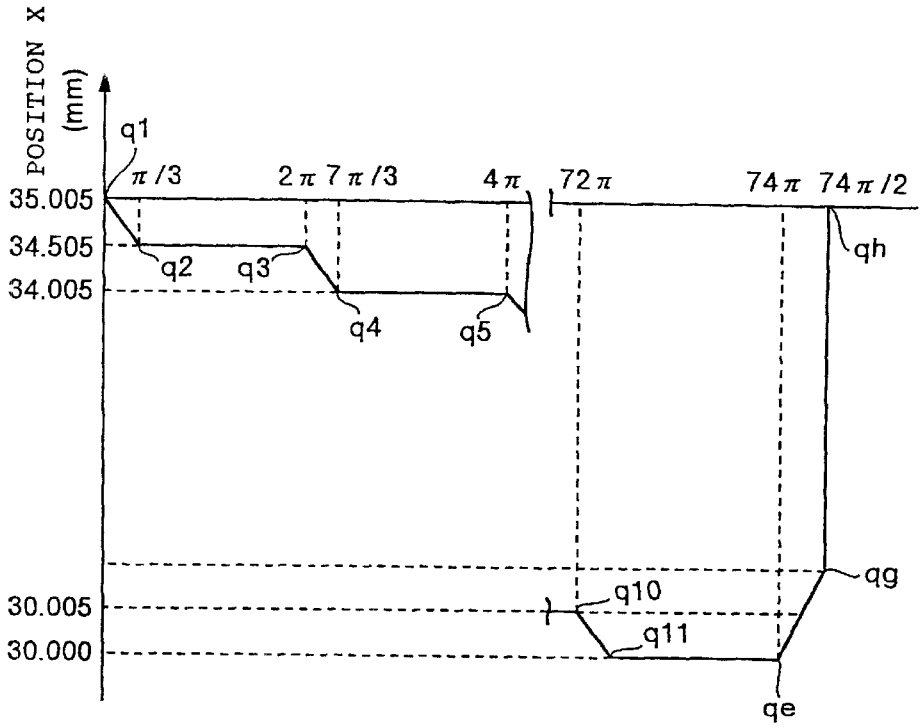
FIG. 5 is an explanatory diagram showing cut-in advance movements and back-off movement of the grinding wheel in the embodiment of the present invention.
Figure 6:
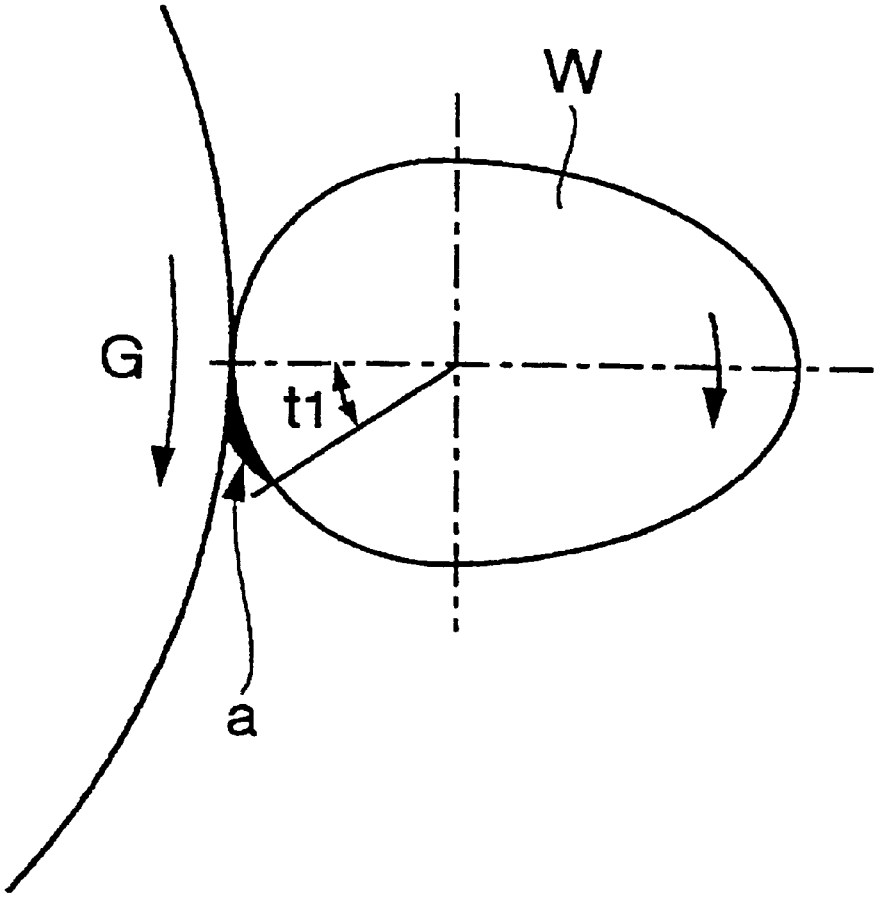
FIG. 6 is an explanatory diagram showing the state after completion of second finish grinding.

FIG. 6 shows a state after completion of the sixth step (i.e., second finish grinding) at point qe of FIG. 5. The final or second finish grinding is performed in such a manner that within the section between point q10 and point q11, profile generation grinding and cut-in feed in an amount of 0.005 mmϕ are performed simultaneously over a cut-in angle (ti) of 20°; and within the section between point q11 and point qe, second finish profile grinding is performed. Therefore, within the section between point q10 and point q11, the diameter of the workpiece gradually decreases from 30.005 mm to 30.000 mm over an angle of 20°. Therefore, within the angular range from 0° to 20°, the workpiece has a small volume of an unground portion (a) as measured with respect to the finish diameter of 30.000 mm.

When a conventional grinding method is employed, a large volume of an unground portion (a) remains, due to a large cut-in angle (e.g., 60° shown in column t3). In such a case, spark-out grinding must be performed until the workpiece rotates at least one turn in order to remove the unground portion.

By contrast, in the present invention, the unground portion (a) is ground by means of the back-off movement of the grinding wheel G within the section between point qe and point qg in FIG. 5 in order to omit spark-out grinding. In order to accomplish this, the cut-in angle during the final finish grinding must be as small as 20°, and within the section between point qe and point qg, the grinding wheel must gradually retract, while effecting profile generation movement, in accordance with the composite data obtained through superposition of the back-off movement on the profile generation movement, over an angle of 90°, which is sufficiently greater than the cut-in angle of 20°. Since the volume of the unground portion (a) is small and the back-off movement of the grinding wheel G is gradually performed over 90° along with profile generation movement, the unground portion (a) can be ground to a sufficient degree during the back-off movement. Therefore, spark-out grinding can be omitted in order to shorten the machining time, as compared with the conventional grinding method.

In the present invention, the back-off angle over which the grinding wheel G causes back-off movement is typically set to 90°, and the cut-in angle over which the grinding wheel G causes cut-in movement during the final finish grinding is set to be smaller than the back-off angle, preferably, not greater than one-third the back-off angle.

Moreover, as shown in columns t1 and t2 of the Table, the cut-in angle is decreased toward the final finish grinding. Therefore, the volume of an unground portion (a) left after completion of the final finish grinding decreases, thereby enabling highly accurate grinding.

In the above-described embodiment, the grinding method of the present invention is applied to grinding of a cam, which is a non-circular workpiece. However, the present invention can be applied to the case in which a workpiece, such as a crank pin, which has a circular cross section and is eccentric from the rotation axis is ground by means of profile generation movement of a grinding wheel.

Obviously, numerous modifications and variations of the present invention are possible in light of the above teachings. It is therefore to be understood that within the scope of the appended claims, the present invention may be practiced otherwise than as specifically described herein.

What is claimed is:

1. A method for grinding a circular or non-circular workpiece in a plurality of grinding steps, the method comprising:

causing a grinding wheel to effect profile generation movement in synchronism with rotation of the workpiece and in accordance with profile data derived from the target shape of the workpiece;

advancing, in each grinding step, the grinding wheel in such a manner that the grinding wheel causes cut-in movement within a predetermined cut-in angle defined on the workpiece; and retracting, after completion of a final finish grinding step, the grinding wheel over a predetermined back-off angle defined on the workpiece, the retraction being effected in accordance with composite data obtained through combining the profile data and back-off data, the back-off angle being greater than the cut-in angle employed during the final finish grinding step.

2. A method for grinding a circular or non-circular workpiece according to claim 1, wherein the cut-in angle employed during the final finish grinding is not greater than one-third the back-off angle.

3. A method for grinding a circular or non-circular workpiece according to claim 2, wherein the cut-in angle is decreased stepwise toward the final finish grinding step.

4. A method for grinding a circular or non-circular workpiece according to claim 3, wherein the back-off angle is 90°.

5. A method for grinding a circular or non-circular workpiece according to claim 2, wherein the back-off angle is 90°.

6. A method for grinding a circular or non-circular workpiece according to claim 1, wherein the cut-in angle is decreased stepwise toward the final finish grinding step.

7. A method for grinding a circular or non-circular workpiece according to claim 6, wherein the back-off angle is 90°.

8. A method for grinding a circular or non-circular workpiece according to claim 1, wherein the back-off angle is 90°.

9. A numerically controlled grinding machine for grinding a circular or non-circular workpiece in a plurality of grinding steps, the grinding machine comprising:

a movement mechanism for moving a grinding wheel relative to the workpiece;

a storage unit for storing profile data derived from the target shape of the workpiece and defining profile generation movement of a grinding wheel to be performed in synchronism with rotation of the workpiece, machining cycle data defining at least a cut-in feed amount and a cut-in angle to be used in each grinding step, and back-off data defining at least a back-off angle to be used in a back-off step; and a control unit connected to the movement mechanism and the storage unit, the control unit causing the grinding wheel to effect profile generation movement in synchronism with rotation of the workpiece and in accordance with the profile data; advancing, in each grinding step, the grinding wheel in such a manner that the grinding wheel undergoes cut-in movement within a corresponding cut-in angle; and retracting, after completion of a final finish grinding step, the grinding wheel over the back-off angle, the retraction being effected in accordance with composite data obtained through combining the profile data and back-off data, the back-off angle being greater than the cut-in angle employed during the final finish grinding step.

10. A numerically controlled grinding machine according to claim 9, wherein the control unit decreases the cut-in angle stepwise toward the final finish grinding step.

* * * * *